United States Patent [19]

Carr et al.

[11] Patent Number: 5,044,595

[45] Date of Patent: Sep. 3, 1991

[54] COLLAPSIBLE PODIUM

[75] Inventors: Arthur G. Carr, Washington, D.C.; William D. Griffiths, Annandale, Va.

[73] Assignee: Nomadic Structures, Inc., Springfield, Va.

[21] Appl. No.: 444,592

[22] Filed: Dec. 1, 1989

[51] Int. Cl.[5] ..... A47B 47/00

[52] U.S. Cl. ..... 248/460; 312/108

[58] Field of Search ..... 248/460, 441.1, 150, 248/165; 182/150; 312/108

[56] References Cited

U.S. PATENT DOCUMENTS

| | | | |
|---|---|---|---|
| 270,409 | 9/1883 | Hannah . | |
| 277,625 | 2/1885 | Hannah . | |
| 835,508 | 11/1906 | Faust | 312/108 |
| 2,083,114 | 6/1937 | Blechman | 312/108 |
| 2,902,328 | 9/1959 | Auer | 312/108 |
| 2,962,334 | 11/1960 | Dutmers | 312/108 |
| 3,640,576 | 2/1972 | Morrison et al. . | |
| 4,007,538 | 2/1977 | Petrie . | |
| 4,023,871 | 5/1977 | Dantzler | 312/108 X |
| 4,443,046 | 4/1984 | Hannah . | |
| 4,579,066 | 4/1986 | Zeigler . | |
| 4,619,486 | 10/1986 | Hannah et al. . | |
| 4,844,566 | 7/1989 | Moore et al. | 312/108 |

FOREIGN PATENT DOCUMENTS

| | | | |
|---|---|---|---|
| 2113989 | 8/1983 | United Kingdom | 312/108 |

OTHER PUBLICATIONS

The Rollerboard TM Brochure.
The Kwik-Wrap Price List.

*Primary Examiner*—Alvin C. Chin-Shue
*Attorney, Agent, or Firm*—Merchant, Gould, Smith, Edell, Welter & Schmidt

[57] ABSTRACT

A kit for constructing a collapsible podium which includes a laterally pliable yet longitudinally rigid panel such as tambour and a top plate with a circumferential channel into which one of the conformable edges of the panel is operably receivable by using a sloped guiding wall on the plate. The kit may also include a bottom plate with a circumferential channel into which the other conformable edge of the panel is operably receivable by using a sloped guiding wall.

23 Claims, 7 Drawing Sheets

FIG.1
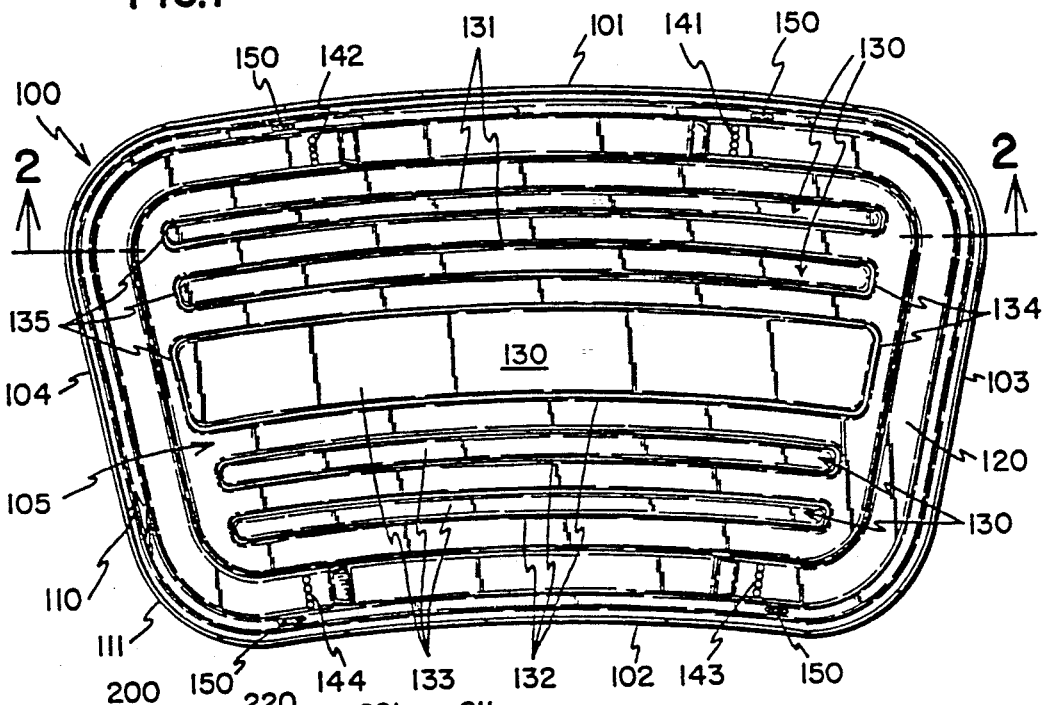
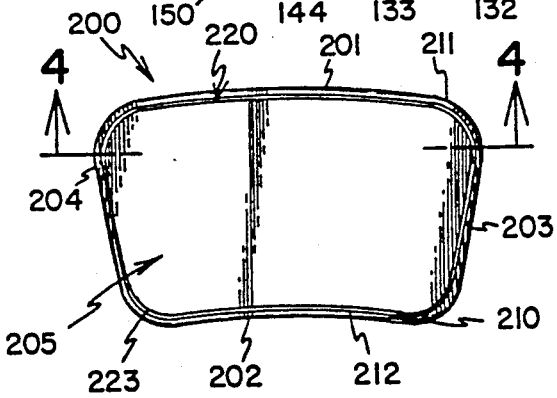
FIG.3
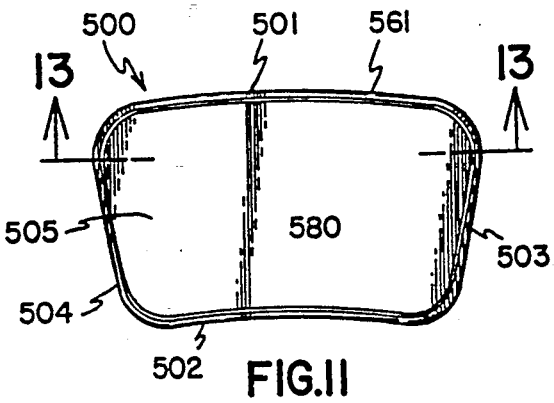
FIG.11

COLLAPSIBLE PODIUM

FIELD OF THE INVENTION

The invention relates to podiums. More specifically, the invention relates to collapsible podiums.

BACKGROUND

Conventional podiums are not generally transportable or storable because of their cumbersome size and weight. While the need for a readily transportable and storable podium has been recognized for many years, attempts to provide such a podium have generally resulted in a podium which is exceedingly difficult to assemble/disassemble, structurally defective and/or excessively heavy. Hence, a need still exists for a lightweight, structurally stable, readily transportable and storable podium which is simple to assemble and disassemble.

SUMMARY OF THE INVENTION

A kit for constructing a collapsible podium which includes, in a first embodiment, (i) a laterally pliable yet longitudinally rigid panel, (ii) a first plate with an upwardly facing, substantially circumferential channel into which the bottom edge of the panel is operably receivable, and (iii) a second plate with a downwardly facing, substantially circumferential channel into which the top edge of the panel is operably receivable.

In a second embodiment the kit also includes (iv) a second laterally pliable yet longitudinally rigid panel, (v) an upwardly facing, substantially circumferential channel in the second plate into which the bottom edge of the second panel is operably receivable, and (vi) a third plate with a downwardly facing, substantially circumferential channel into which the top edge of the second panel is operably receivable.

The panel(s) may be provided with longitudinal support channels operably secured proximate the right and left edge(s) of the panel. The longitudinal support channels provide additional longitudinal support at the right and left edges of the panel(s) which are subjected to a greater compressive pressure than the rest of the panel when the panel is configured to leave an opening between the panel edges.

A podium constructed from the kit preferably defines a chamber which is open and accessible through the rear of the podium such that objects may be readily placed into and withdrawn from the podium chamber by someone using the podium.

DEFINITIONS

As utilized herein, including the claims, the phrase "center to center" refers to the distance between the center of a first object and the center of a second object. Specifically, the term "center to center", when utilized to describe the lateral spacing of longitudinal strips in a tambour-type panel, means the lateral distance between the lateral center of a first strip and the lateral center of an adjacent strip.

As utilized herein, including the claims, the phrase "substantially circumferential" means proximate the periphery.

As utilized herein, including the claims, the term "channel depth" means the longitudinal distance from the bottom of the channel to the point at which either a side of the channel ceases or the lateral distance between the sides exceeds the width of the panel inserted therein.

As utilized herein, including the claims, the term "lateral" means from side to side (right/left).

As utilized herein, including the claims, the term "longitude" means from top to bottom.

As utilized herein, including the claims, the term "completely pliable" means readily flexible in all directions.

As utilized herein, including the claims, the term "operably receivable" means capable of being received in such a manner that the combination can perform an intended and desired function.

As utilized herein, including the claims, the term "positive retaining means" refers to devices capable of providing active securement such as clips, hooked/-looped tape, ratchet systems and the like.

Nomenclature

100 first plate subunit (fps)
101 front edge of fps
102 back edge of fps
103 right edge of fps
104 left edge of fps
105 top surface of fps
106 bottom surface of fps
110 circumferential channel on fps
**110*d*** depth of circumferential channel on fps
**110*w*** width of circumferential channel on fps
111 outer wall of circumferential channel on fps
112 inner wall of circumferential channel on fps
113 bottom wall of circumferential channel on fps
120 circumferential guiding rib on fps
**120*h*** height of circumferential guiding rib on fps
121 outer wall of circumferential guiding rib on fps
122 inner wall of circumferential guiding rib on fps
123 top of circumferential guiding rib on fps
130 lateral stiffening ribs on fps
**130*h*** height of lateral stiffening ribs on fps
131 front wall of lateral stiffening ribs on fps
132 back wall of lateral stiffening ribs on fps
133 top of lateral stiffening ribs on fps
134 right side of lateral stiffening ribs on fps
135 left side of lateral stiffening ribs on fps
141 right edge panel alignment indicator for front edge of fps
142 left edge panel alignment indicator for front edge of fps
143 right edge panel alignment indicator for back edge of fps
144 left edge panel alignment indicator for back edge of fps
150 hooked surface dots on fps
200 second plate subunit (sps)
201 front edge of sps
202 back edge of sps
203 right edge of sps
204 left edge of sps
205 top surface of sps
206 bottom surface of sps
210 circumferential channel on sps
**210*d*** depth of circumferential channel on sps
**210*w*** width of circumferential channel on sps
211 outer wall of circumferential channel on sps
212 inner wall of circumferential channel on sps
213 bottom wall of circumferential channel on sps
220 circumferential guiding rib on sps
**220*h*** height of circumferential guiding rib on sps

221 outer wall of circumferential guiding rib on sps
222 inner wall of circumferential guiding rib on sps
223 top of circumferential guiding rib on sps
300 base plate (bp)
301 front edge of bp
302 back edge of bp
303 right edge of bp
304 left edge of bp
305 top surface of bp
306 bottom surface of bp
310 circumferential channel on bp
**310*d*** depth of the circumferential channel on bp
**310*w*** width of the circumferential channel on bp
311 outer wall of circumferential channel on bp
312 inner wall of circumferential channel on bp
313 bottom wall of circumferential channel on bp
320 circumferential guiding rib on bp
**320*h*** height of circumferential guiding rib on bp
321 outer wall of circumferential guiding rib on bp
322 inner wall of circumferential guiding rib on bp
323 top of circumferential guiding rib on bp
330 lateral stiffening ribs on bp
**330*h*** height of lateral stiffening ribs on bp
331 front wall of lateral stiffening ribs on bp
332 back wall of lateral stiffening ribs on bp
333 top of lateral stiffening ribs on bp
334 right side of lateral stiffening ribs on bp
335 left side of lateral stiffening ribs on bp
341 right edge panel alignment indicator
342 left edge panel alignment indicator
343 right edge panel alignment indicator for back edge of bp
344 left edge panel alignment indicator for back edge of bp
350 hooked surface dots on fp
400 middle plate (mp)
401 front edge of mp
402 back edge of mp
403 right edge of mp
404 left edge of mp
405 top surface of mp
406 bottom surface of mp
410 lower circumferential channel on mp
**410*d*** depth of lower circumferential channel on mp
**410*w*** width of lower circumferential channel on mp
411 outer wall of lower circumferential channel on mp
412 inner wall of lower circumferential channel on mp
413 bottom wall of lower circumferential channel on mp
420 lower circumferential guiding rib on mp
**420*h*** height of lower circumferential guiding rib on mp
421 outer wall of lower circumferential guiding rib on mp
422 inner wall of lower circumferential guiding rib on mp
423 top of lower circumferential guiding rib on mp
430 lateral stiffening ribs on mp
**430*h*** height of lateral stiffening ribs on mp
431 front wall of lateral stiffening ribs on mp
432 back wall of lateral stiffening ribs on mp
433 top of lateral stiffening ribs on mp
434 right side of lateral stiffening ribs on mp
435 left side of lateral stiffening ribs on mp
433 top of lateral stiffening ribs on mp
441 right edge panel alignment indicator for front edge of mp
442 left edge panel alignment indicator for front edge of ms
443 right edge panel alignment indicator for back edge of ms
444 left edge panel alignment indicator for back edge of ms
450 hooked surface dots on ms
460 upper circumferential channel on mp
**460*d*** depth of upper circumferential channel on mp
**460*w*** width of upper circumferential channel on mp
461 outer wall of upper circumferential channel on mp
462 inner wall of upper circumferential channel on mp
463 bottom wall of upper circumferential channel on mp
470 upper circumferential guiding rib on mp
**470*h*** height of upper circumferential guiding rib on mp
471 outer wall of upper circumferential guiding rib on mp
472 inner wall of upper circumferential guiding rib on mp
473 top of upper circumferential guiding rib on mp
480 flat portion of top of mp
500 top plate (tp)
501 front edge of tp
502 back edge of tp
503 right edge of tp
504 left edge of tp
505 top surface of tp
506 bottom surface of tp
520 lower circumferential guiding rib on tp
**520*h*** height of lower circumferential guiding rib on tp
521 outer wall of lower circumferential guiding rib on tp
**521*a*** distal end of lower circumferential guiding rib outer wall
522 inner wall of lower circumferential guiding rib on tp
523 top of lower circumferential guiding rib on tp
530 lateral stiffening ribs on tp
**530*h*** height of lateral stiffening ribs on tp
531 front wall of lateral stiffening ribs on tp
532 back wall of lateral stiffening ribs on tp
533 top of lateral stiffening ribs on tp
534 right side of lateral stiffening ribs on tp
535 left side of lateral stiffening ribs on tp
541 right edge panel alignment indicator for front edge of tp
542 left edge panel alignment indicator for front edge of ts
543 right edge panel alignment indicator for back edge of ts
544 left edge panel alignment indicator for back edge of ts
550 hooked surface dots on tp
560 circumferential channel on tp
**560*d*** depth of circumferential channel on tp
**560*w*** width of circumferential channel on tp
561 outer wall of circumferential channel on tp
562 inner wall of circumferential channel on tp
563 bottom wall of circumferential channel on tp
570 upper circumferential guiding rib on tp
**570*h*** height of upper circumferential guiding rib on tp 571 outer wall of upper circumferential guiding rib on tp
572 inner wall of upper circumferential guiding rib on tp
573 bottom wall of upper circumferential guiding rib on tp
580 flat portion of top of tp
600 panel laminate
600*w* width of panel laminate
610 longitudinal strut
610*t* strut thickness
610*w* strut width
611 front face of longitudinal strut
612 back face of longitudinal strut
613 right side of longitudinal strut
614 left side of longitudinal strut
615 longitudinal ends of the longitudinal strut
616 lateral center of longitudinal strut
617 longitudinal groove between longitudinal struts
620 backing layer
630 cover layer
700 lower panel (lp)
701 top edge of lp
702 bottom edge of lp
703 right edge of lp
704 left edge of lp
705 inner surface of lp
706 outer surface of lp
711 lower panel right edge support channel
712 lower panel left edge support channel
713 rivets
800 upper panel (up)
801 top edge of up
802 bottom edge of up
803 right edge of up
804 left edge of up
805 inner surface of up
806 outer surface of up
811 upper panel right edge support channel
812 upper panel left edge support channel
813 rivets
1000 podium
1001 front of podium
1002 rear of podium
1003 right side of podium
1004 left side of podium
1005 top of podium
1006 bottom of podium
1010 podium chamber
1011 upper portion of podium chamber
1012 opening into upper portion of podium chamber
1013 lower portion of podium chamber
1014 opening into lower portion of podium chamber

BRIEF DESCRIPTION OF THE DRAWINGS

FIG. 1 is a top view of one embodiment of a first plate subunit.

FIG. 3 is a top view of one embodiment of a second plate subunit.

FIG. 11 is a top view of one embodiment of a top plate.

DETAILED DESCRIPTION OF THE INVENTION INCLUDING A BEST MODE

Figure 4:
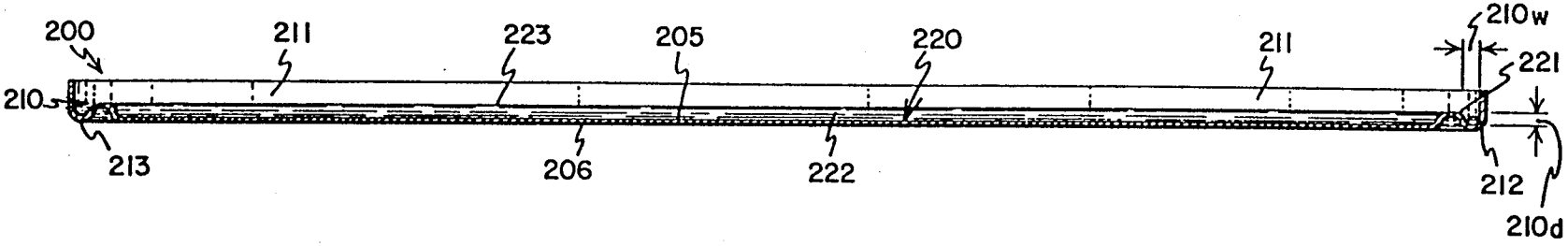
FIG. 4 is a cross-sectional view of the second plate subunit depicted in FIG. 3 taken along line 4—4.
Figure 2:
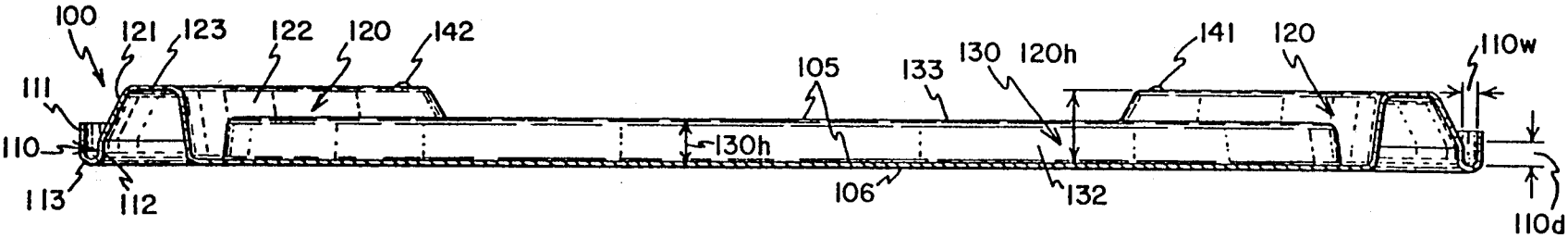
FIG. 2 is a cross-sectional view of the first plate subunit depicted in FIG. 1 taken along line 2—2.
Figure 5:
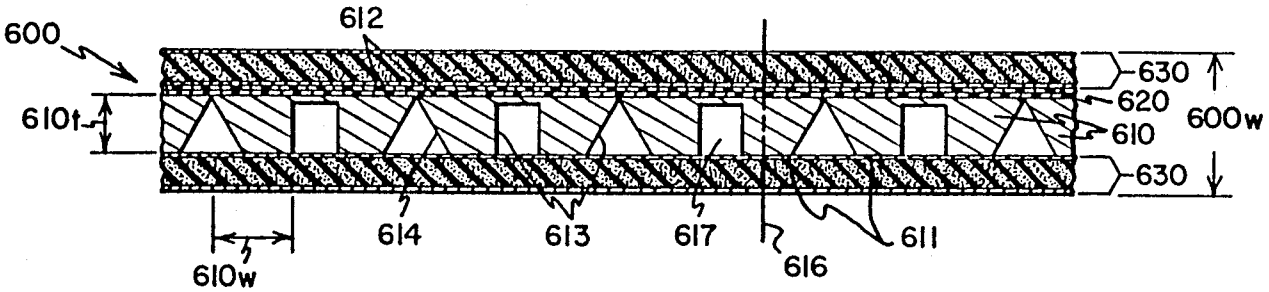
FIG. 5 is a cross-sectional view of one embodiment of a laminated panel useful in the invention.
Figure 6:
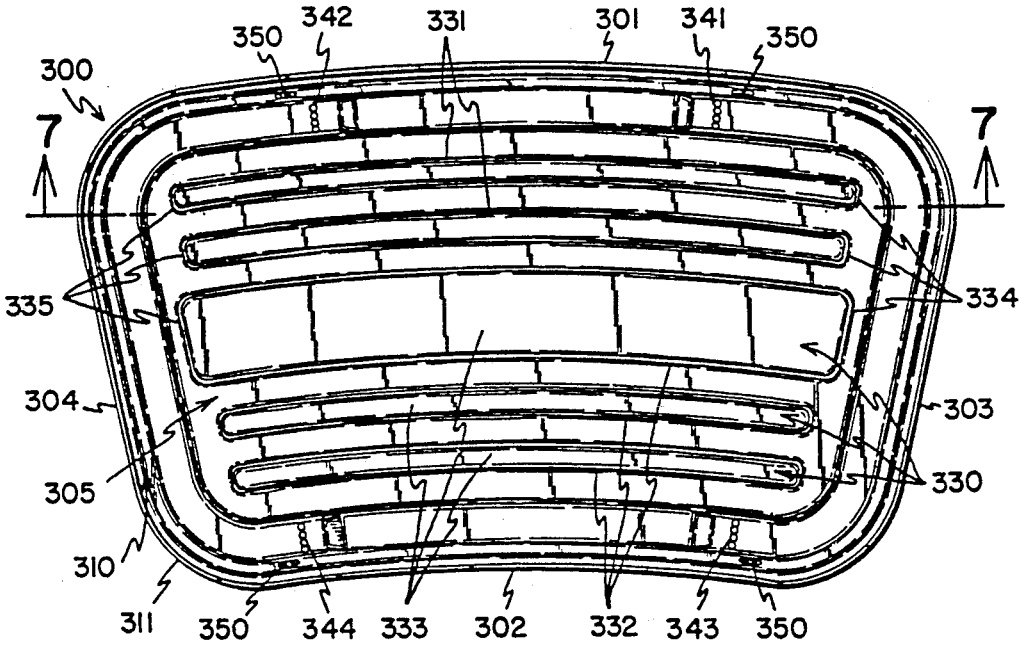
FIG. 6 is a top view of one embodiment of a base plate.
Figure 12:
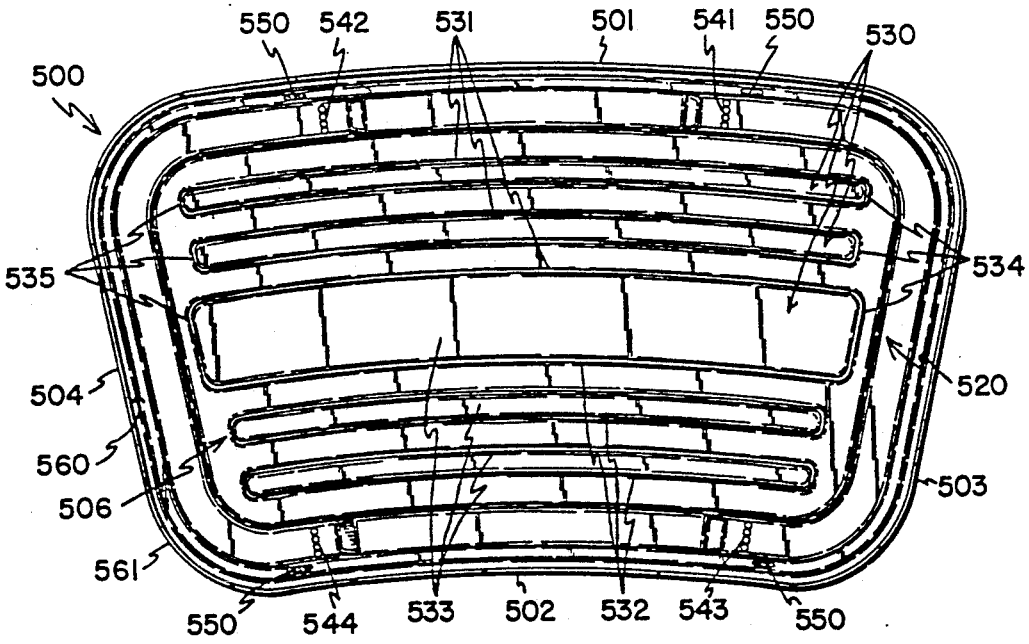
FIG. 12 is a bottom view of the top plate depicted in FIG. 11.

Referring to FIG. 1, the kit for constructing the collapsible podium 1000 includes a base plate 300 constructed from a first plate subunit 100, a middle plate 400 constructed from a first plate subunit 100 and a second plate subunit 200, a top plate 500 constructed from a modified first plate subunit 100 and a second plate subunit 200, a lower panel 700 and an upper panel 800. Briefly, a podium 1000 is constructed from the plates 300,400,500 and panels 700,800 by (i) inserting the bottom edge 702 of the lower panel 700 into an upwardly facing circumferential channel 310 in the base plate 300, (ii) guiding the top edge 701 of the lower panel 700 into a downwardly facing circumferential channel 410 in the middle plate 400, (iii) inserting the bottom edge 802 of the upper panel 800 into an upwardly facing circumferential channel 460 in the middle plate 400, and then (iv)guiding the top edge 801 of the upper panel 800 into a downwardly facing circumferential channel 510 in the top plate 500.

Figures 7, 10, 13:
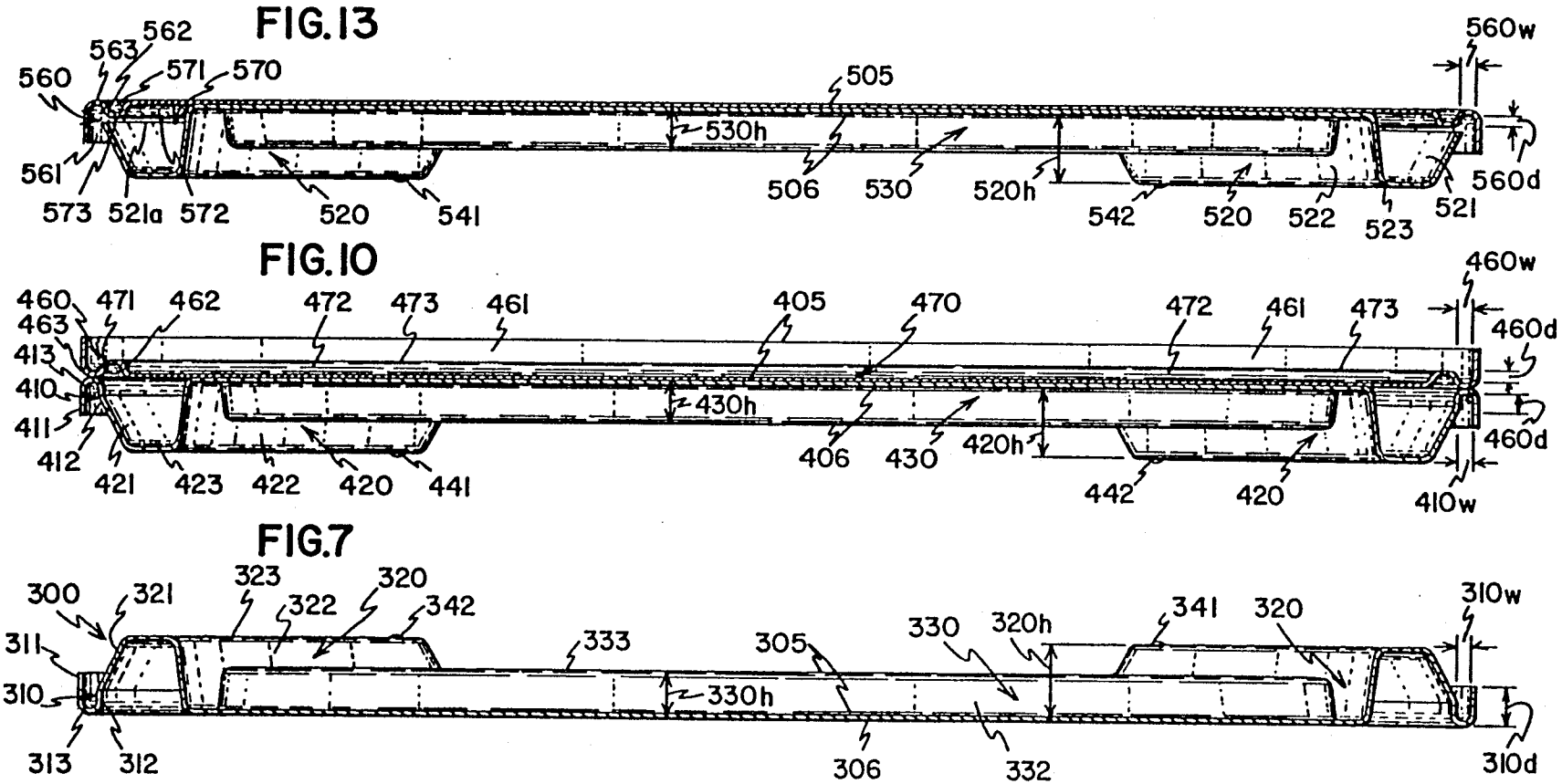
FIG. 7 is a cross-sectional view of the base plate depicted in FIG. 6 taken along line 7—7.
FIG. 10 is a cross-sectional view of the middle plate depicted 8 taken along line 10—10.
FIG. 13 is a cross-sectional view of the top plate depicted in FIG. 11 taken along line 13—13.
Figure 18:
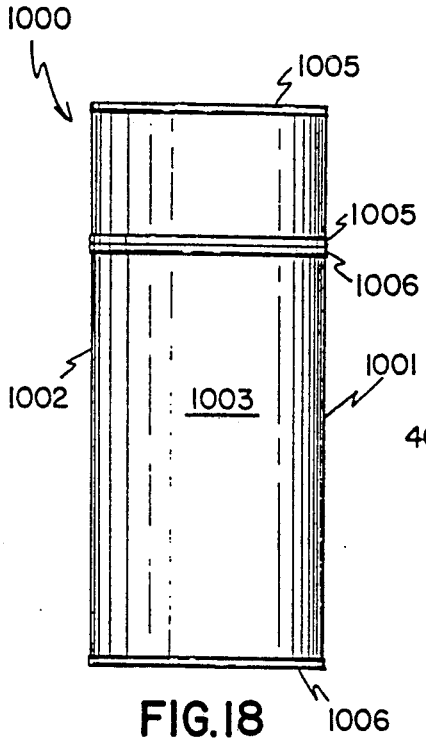
FIG. 18 is a right side view of the podium depicted in FIG. 14.
Figure 8:
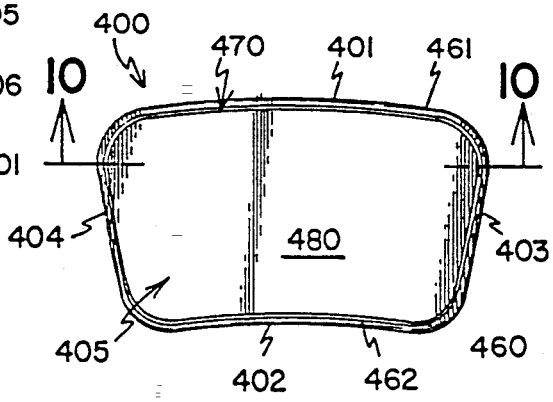
FIG. 8 is a top view of one embodiment of a middle plate.
Figure 19:
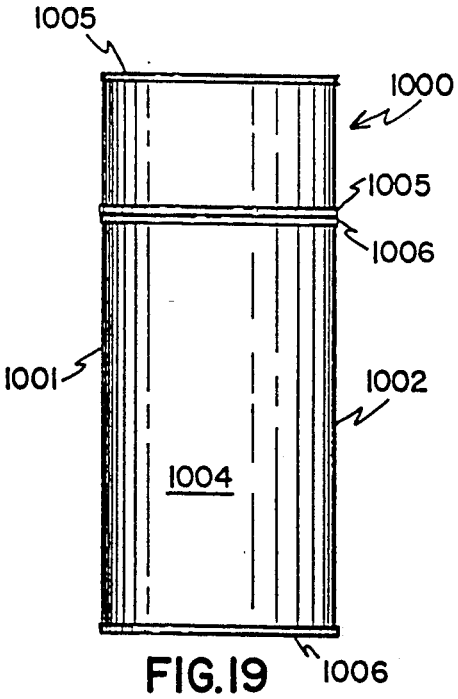
FIG. 19 is a left side view of the podium depicted in FIG. 14.
Figure 9:
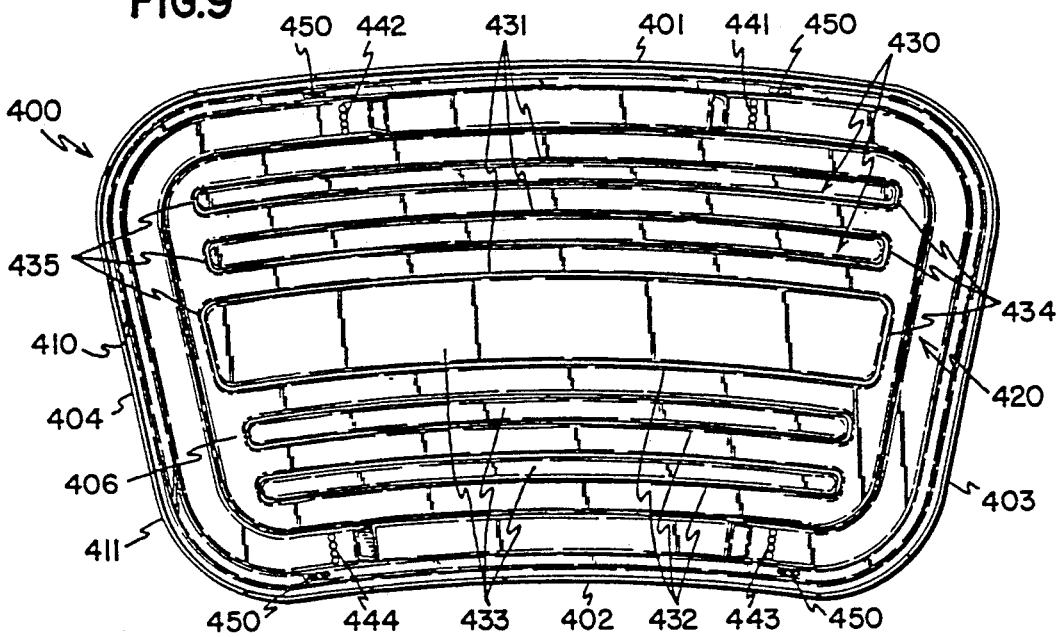
FIG. 9 is a bottom view of the middle plate depicted in FIG. 8.
Figure 14:
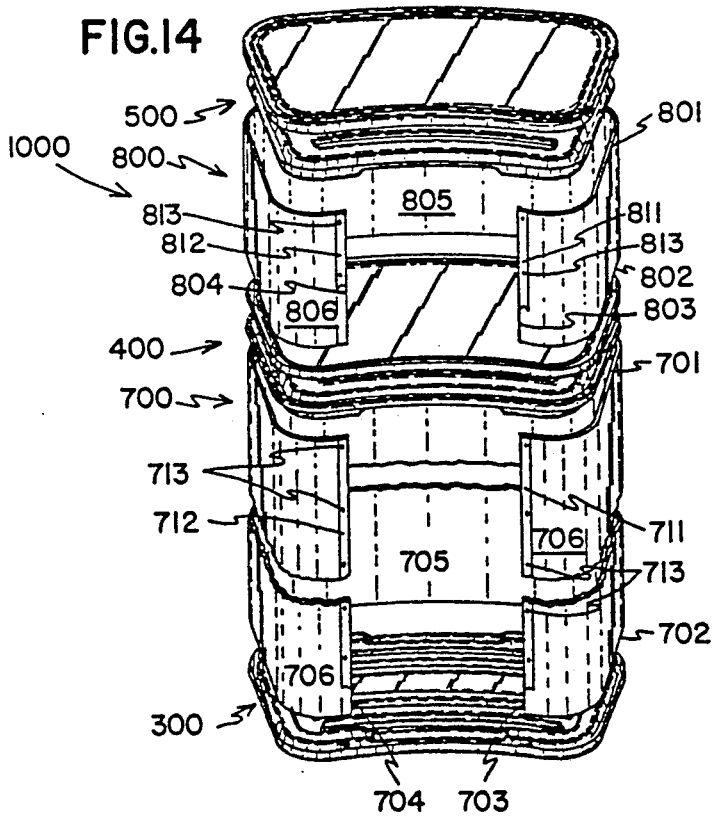
FIG. 14 is an exploded perspective view of a podium constructed from the plates and panels depicted in FIGS. 5–15.
Figure 15:
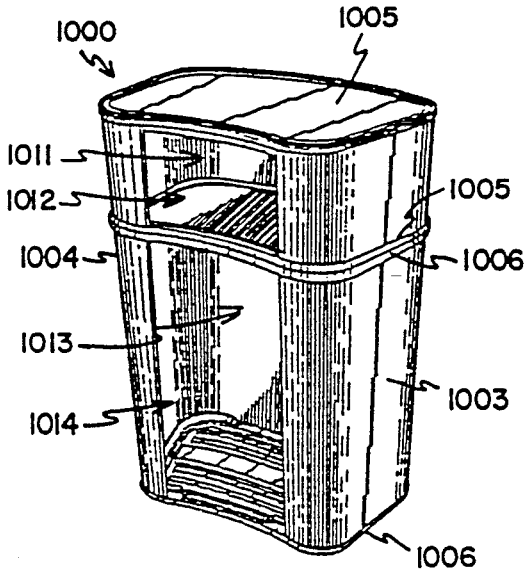
FIG. 15 is a rear perspective view of the podium depicted in FIG. 14.
Figure 16:
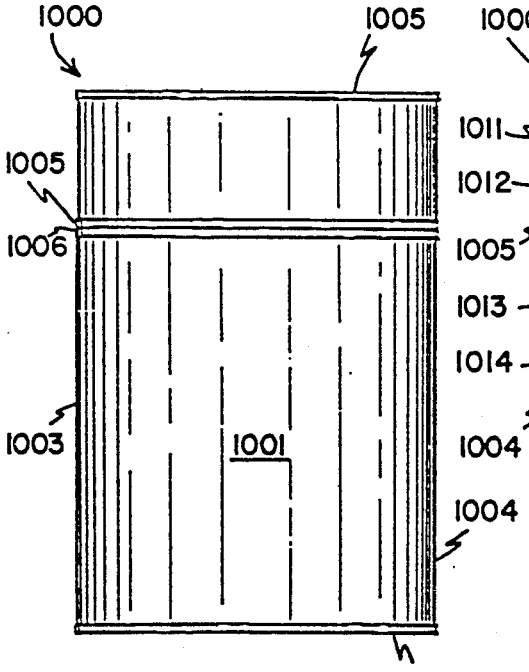
FIG. 16 is a front view of the podium depicted in FIG. 14.
Figure 17:
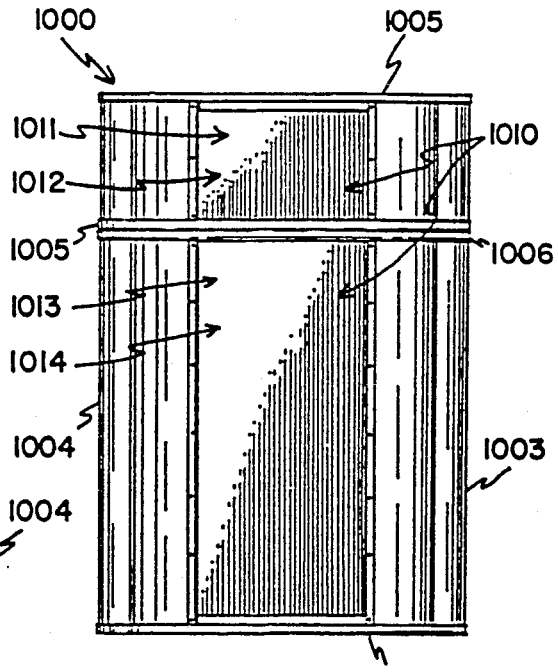
FIG. 17 is a rear view of the podium depicted in FIG. 14.

The three plates 300,400,500 are conveniently constructed from two vacuum-formed, plastic plate subunits 100,200. Referring to FIG. 10, the first plate subunit 100 has a generally rounded trapezoidal peripheral configuration which defines a front edge 101, a back edge 102, a right edge 103, a left edge 104, a top surface 105 and a bottom surface 106 which provides a level base. The first plate subunit 100 includes an upwardly facing circumferential channel 110, a circumferential guiding rib 120, lateral stiffening ribs 130, and panel alignment indicators 141,142.

The circumferential channel 110 on the first plate subunit 100 is a continuous channel 110 which extends completely around the periphery of the first plate subunit 100. The circumferential channel 110 is defined by an outer wall 111 which also defines the periphery of the first plate subunit 100, an inner wall 112, and a bottom wall 113. The circumferential channel 110 should have a depth 110*d* of about 0.5 cm to about 4 cm. A depth of less than about 0.5 cm does not typically provide effective retention of a panel 700,800 while a depth of more than about 4 cm increases the bulkiness of the first plate subunit 100 without providing a commensurate benefit. The circumferential channel 110 should have a minimum width 110*w* which is slightly less than the width 700*w*,800*w* of the panel 700,800 which is to be introduced into the circumferential channel 110 such that insertion of a panel edge 701,702,801,802 into the circumferential channel 110 causes the channel walls 111,112 to retainably pinch the panel laminate 600 within the circumferential channel 110.

The circumferential guiding rib 120 on the first plate subunit 100 extends continuously around the periphery of the first panel subunit 100 immediately inside the circumferential channel 110. The circumferential guiding rib 120 is defined by a sloped outer wall 121 which also defines the inner wall 112 of the circumferential channel 110, an inner wall 122, and a top 123. The outer wall 121 of the circumferential guiding rib 120 is sloped towards the circumferential channel 110 in order to assist in insertion/guidance of a panel edge 701,702,801,802 into the circumferential channel 110. The outer wall 121 of the circumferential guiding rib 120 should be slightly higher than the outer wall 111 of the circumferential channel 110 so that the outer wall 121 may serve as a guide for insertion of a panel 700,800 into the circumferential channel 110.

The lateral stiffening ribs 130 on the first plate subunit 100 extend laterally along the first plate subunit 100 inside the circumferential guiding rib 120 in order to enhance the structural integrity of the first plate subunit 100 in the lateral direction. The lateral stiffening ribs 130 are defined by a front wall 131, a back wall 132, and a top 133. The desired height of the lateral stiffening ribs 130 depends upon various factors including the material of construction, the thickness of the material, the number of ribs 130 etc. However, as a general matter, lateral stiffening ribs 130 having a height 130*h* of about 1 to about 3 cm are typically sufficient to achieve the desired effect. A height of less than about 1 cm typically does not provide effective structural support while a height of more than about 3 cm increases the bulk of the first plate subunit 100 without providing a commensurate increase in the rigidity of the first plate subunit 100.

To aid in assembly, the first plate subunit 100 include a means 141,142 for indicating the point in the circumferential channel 110 at which the right 703,803 and/or left 803,804 edge(s) of the panels 700,800 should be position for proper assembly.

The height 120*h* of the circumferential guiding rib 120 on the first plate subunit 100 is decreases along the front 101 and back 102 of the subunit 100 between the panel alignment indicators 141,142 and 143,144 to provide lateral stiffness to the guiding rib 120 while still providing a high outer wall 121 of the circumferential guiding rib 120 at the corners for guiding the panel 700,800 into the circumferential channel Referring to FIG. 11, the second plate subunit 200 has a peripheral configuration identical to the first plate subunit 100 which defines a front edge 201, a back edge 202, a right edge 203, a left edge 204, a top surface 205 and a bottom surface 206 on the second plate subunit 200. The second plate subunit 200 includes an upwardly facing circumferential channel 210, a circumferential guiding rib 220, and panel alignment indicators 241,242. The top 205 and bottom 206 surfaces of the second plate subunit 200 are flat inside the circumferential guiding rib 220.

The circumferential channel 210 on the second plate subunit 200 is substantially identical to the circumferential channel 110 on the first plate subunit 100. The circumferential channel 210 on the second plate subunit 200 is a circumferential channel 210 which extends completely around the periphery of the second panel subunit 200. The circumferential channel 210 is defined by an outer wall 211 which also defines the periphery of the second plate subunit 200, an inner wall 212, and a bottom wall 213. The depth 210*d* and width 210*w* of the circumferential channel 210 on the second plate subunit 200 should be the same as those for the circumferential channel 110 on the first plate subunit 100 for the same reasons. The circumferential channel 210 on the second plate subunit 200 is vertically configured so that the bottom wall 213 of the circumferential channel 210 is slightly lower than the flat inner bottom surface 206 of the second plate subunit 200.

As with the circumferential guiding rib 120 on the first plate subunit 100, the circumferential guiding rib 220 on the second plate subunit 200 extends continuously along the periphery of the second plate subunit 200 immediately inside the circumferential channel 210. The circumferential guiding rib 220 on the second plate subunit 200 is defined by an outer wall 221 which also defines the inner wall 212 of the circumferential channel 210, an inner wall 252, and a top 223. The circumferential guiding rib 270 should have a height 270*h* sufficient to provide an effective outer wall 221 for forming the circumferential channel 210.

As with the first plate subunit 100, the second plate subunit 200 include a means 241,242 for indicating the point in the circumferential channel 210 at which the right 703,803 and/or left 803,804 edge(s) of the panels 700,800 should be position for proper assembly.

The second plate subunit 200 preferably defines a flat surface area within the peripheral channel 210 which is sufficient to support at least two separately placed sheets of 8" by 11" paper. Typically, an area of about 100 to 500 square inches is sufficient. Use of plates having a flat surface area of less than about 100 square inches results in the podium which is generally to small to be useful while plates having a surface area of greater than about 500 square inches results in a kit which is cumbersome to transport.

The base plate 300 provided in the kit is simply a first plate subunit 100. The bottom surface 106 of the first plate subunit 100 provides effective stability while the circumferential channel 110 provides for operable retention of the bottom edge 702 of the lower panel 700.

The middle plate 400 is constructed from a first plate subunit 100 and a second plate subunit 200 by peripherally aligning and coupling the bottom surface 106 of the first plate subunit 100 to the bottom surface 206 of the second plate subunit 200 such that the top surface 105 of the first plate subunit 100 forms the bottom surface 406 of the middle plate 400 and the top surface 205 of the second plate subunit 200 forms the top surface 405 of the middle plate 400. The circumferential channel 110 on the first plate subunit 100 forms a downwardly facing lower circumferential channel 410 on the bottom surface 406 of the middle plate 400 while the circumferential channel 210 on the second plate subunit 200 forms an upwardly facing upper circumferential channel 460 on the bottom surface 406 of the middle plate 400. The top surface 205 of the second plate subunit 200 provides a flat top surface 405 for the middle plate 400.

Peripheral alignment of the subunits 100,200 to form the middle plate 400 results in longitudinal alignment of the circumferential channels 110,210 on the subunits 100,200. By coupling the first plate subunit 100 to the flat inner bottom surface 206 of the second plate subunit 200, the bottoms 113,213 of the circumferential channels 110,210 on the first and second plate subunits 100,200 are physically forced into continuous contact regardless of any minor deviations in the configuration of the subunits 100,200 because the bottom wall 213 of the circumferential channel 210 on the second plate subunit 200 is slightly lower than the flat inner bottom surface 206 of the second plate subunit 200 and physically displaces the bottom wall 113 of the circumferential channel 110 on the first plate subunit 100.

The top plate 500 is constructed from a modified first plate subunit 100 and a second plate subunit 200 by centering and coupling the bottom surface 106 of the first plate subunit 100 to the top surface 205 of the second plate subunit 200 such that the top surface 105 of the first plate subunit 100 forms the bottom surface 506 of the top plate 500 and the bottom surface 206 of the second plate subunit 200 forms the top surface 505 of the top plate 500. The first plate subunit 100 is modified by removing the outer and bottom walls 111,113 of the circumferential channel 110 on the first plate subunit 100 as well as a sufficient portion of the outer wall 121 of the circumferential guiding rib 120 to prevent contact between the outer wall 121 of the circumferential guiding rib 120 and the second plate subunit 200 while permitting contact between the distal end 521*a* of the outer wall 521 and the inner surface 705,805 of a panel 700,800 operably retained within the circumferential channel 560 on the top plate 500. Modification of the second plate subunit 200 permits the circumferential channel 20 on the second plate subunit 200 to form a downwardly facing circumferential channel 510 on the top plate 500 and permits the outer wall 121 of the circumferential guiding rib 120 to act as a positive gripping means for actively retaining a panel upper 800 within the circumferential channel 510. The bottom surface 206 of the second plate subunit 200 provides a flat top surface 505 for the top plate 500.

The plate subunits 200,250 may also be constructed from a number of other readily available materials including cellulose-based products such as wood and fiberboard and metals such as steel and aluminum. The material preferably possesses a small degree of flexibility so that the circumferential channels 110,210 can expand slightly to accept a panel edge 701,702,801,802.

The subunits 100,200 may be coupled together to form the middle 400 and top 500 plates by any of the well known methods for joining such structural units. The methods which can be employed to couple the subunits 100,200 naturally depends upon the type of material used to construct the subunits 200,250 and includes such methods as adhesive bonding and screws for cellulosic subunits, welding and rivets for metallic subunits, and adhesive bonding and ultrasonic welding for plastic subunits.

The panels 700,800 must have sufficient structural integrity in the longitudinal direction that a podium 1000 constructed from the kit can support up to at least about 100 kg and preferably up to about 500 kg on either the top 500 or the middle 400 plate. At the same time the panels 700,800 must have sufficient lateral pliability to permit the panel 700,800 to follow the configuration of the circumferential channels 310,410,460,510 in the plates 300,400,500. The necessary longitudinal rigidity and lateral pliability can be provided by constructing the upper and lower panels 700,800 from tambour.

Referring to FIG. 13, a preferred embodiment of the panels 700,800 is a panel laminate 600 which includes laterally spaced longitudinal struts 610, a backing layer 620 laminated to the back face 612 of the longitudinal struts 610, and a cover layer 630 laminated over the front face 611 of the longitudinal struts 610 and the backing layer 620. The cover layer 630 also cover the top 701,801 and bottom 702,802 edges of the panels 700,800 in order to reduce damage to the longitudinal ends 615 of the longitudinal struts 610 during insertion and removal of the panels 700,800 from the circumferential channels 310,410,460,510.

The longitudinal struts 610 may be constructed from any sufficiently rigid structural material including cellulosics such as wood and fiberboard, metals such as steel and aluminum, and plastics such as polyvinlychloride.

The thickness, width and lateral spacing of the longitudinal struts 610 in the panel laminate 600 are interrelated variables which require the balancing of various competing interests. Selection of a strut thickness 610*t* requires balancing of longitudinal rigidity (increased thickness=increased rigidity), transportability (increased thickness=increased bulk), and cost (increased thickness=increased cost). Selection of a strut width 610*w* requires balancing of the competing interests of longitudinal rigidity (increased width= increased rigidity), lateral pliability (increased width=decrease lateral pliability), manufacturing ease (increased width=increased manufacturing ease) and cost (increased width=decreased cost). Selection of the lateral spacing between struts 610 requires balancing of the competing interests of longitudinal rigidity (increased spacing=decreased rigidity) and lateral pliability (increased spacing=increased lateral pliability), transportability (increased spacing=decreased bulk), manufacturing ease (increased spacing=increased manufacturing ease) and cost (increased spacing=decreased cost). With respect to fiberboard struts 610, a thickness of about 2-10 mm, preferably about 3-5 mm, a width of about 3-10 mm, preferably about 3-5 mm, and a right edge 703 to left edge 704 lateral spacing of about 1-5 mm, preferably about 2-3 mm, provides an appropriate balance between these competing interests. Specifically, the width 610*w* of the longitudinal struts 610 is independently limited to less than about 10 mm in order to provide the lateral pliability necessary for configuration of the panels 700,800 into the circumferential channels 310,410,460,510.

The backing layer 620 may be constructed from any sufficiently pliable material including cloth, sheets of paper, plastic films and plastic sheets. The primary function of the backing layer 620 is to provide a layer upon which the longitudinal struts 610 may be configured. A secondary function of the backing layer 620 is to prevent wrinkling of the cover layer 630 laminated to the backing layer 620 when the panel laminate 600 is bent. Generally, the cloth, paper and plastic materials listed above as useful backing layer 620 materials can provide the necessary structural integrity to support the longitudinal struts 610. However, of the listed materials, only plastic sheets having a thickness of at least about 0.01 mm possess sufficient rigidity to prevent wrinkling.

The cover layer 630 may be constructed form any fully pliable, aesthetically pleasing material such as plastic sheets, cloth, foam sheets, carpet-type material and laminates thereof. The cover layer 630 is laminated over the strut/backing layer 610/620 combination by longitudinally wrapping a single sheet of the cover layer material over the front surface, back surface, top edge, and bottom edge of the strut/backing layer 610/620 combination.

Metallic edge support channels 711,712,811,812 are provided over the right 703,803 and left 704,804 edges of the panels 700,800 to provide supplemental longitudinal support at the free edges 703,704,803,804 of the panels 700,800.

A podium 1000 is constructed from the kit by (i) placing the base plate 300 on the floor, (ii) longitudinally aligning the left edge 704 of the lower panel 700 with the left edge panel alignment indicator 342 on the base plate 300, (iii) inserting the bottom edge 702 of the lower panel 700 into the upwardly facing circumferential channel 310 in the base plate 300 while maintaining longitudinally alignment of the panel left edge 704 with the left edge panel alignment indicator 342, (iv) guiding the top edge 701 of the lower panel 700 into the downwardly facing circumferential channel 410 on the middle plate 400 to form a lower podium chamber 1013 having an open rear 1014, (v) longitudinally aligning the left edge 804 of the upper panel 800 with the left edge 704 of the lower panel 700, (vi) inserting the bottom edge 802 of the upper panel 800 into the upwardly facing circumferential channel 460 in the middle plate 400 while maintaining longitudinal alignment of the upper panel left edge 804 with the lower panel left edge 704, (vii) and guiding the top edge 801 of the upper panel 800 into the downwardly facing circumferential channel 510 on the top plate 500 to form an upper podium chamber 1011 having an open rear 1012 longitudinally aligned with the opening 1014 in the rear of the lower podium chamber 1013.

Positive gripping means 350, such as dots of hooked tape, are placed within the circumferential channel 310 on the inner wall 312 of the channel 310 just outside of the right edge 341 and left edge 342 panel alignment indicators for actively gripping the lower panel 700 proximate the right 703 and left 704 edges of the panel. These positive gripping means 350 greatly reduce the tendency of the lower panel 700 to slip out of the circumferential channel 310 under typical use conditions and during transportation of the assembled podium 1000. Such positive gripping means 350 may also be similarly positioned within the other circumferential channels 410,460,510 if desired.

Construction of a podium 1000 utilizing two panels 700,800 and a middle plate 400 rather than one panel having the same longitudinal dimensions as both of the panels 700,800 provides a longitudinally sturdier podium 1000 as well as a middle shelf.

The fully constructed podium 1000 preferably has a height of about 2.5 to 5 feet with a lower panel which is about 2 feet to about 4.5 feet tall, an upper panel which is about 0.5 to about 2 feet tall and a height ratio between the lower and upper panels of about 1:1 to about 1:3. The podium chamber 1010 preferably has a length (right to left) of about 1 to 3 feet and a depth (front to rear) of about 10 inches to about 2 feet.

The kits permits construction of either (a) a floor podium 1000 utilizing all three plates 300,400,500 and both panels 700,800, (b) a table (not shown individually) utilizing only the base 300 and top 500 plates with the lower panel 700, or (c) a table top podium (not shown individually) utilizing only the base 300 and middle 400 or base 300 and top 500 plates with the upper panel 800.

The topography of the bottom surface 506 on the top plate 500 and the topography of the top surface 405 on the middle plate 400 are compatibly configured so that the top plate 500 can be securely rested on top of the middle plate 400 to provide a top surface 505 on the table or table-top podium which does not have an upwardly extending peripheral lip created by the outer wall 461 of the upper circumferential channel 460 on the middle plate 400. Such coupling of the top 500 and middle 400 plates may be provided by compatibly configuring the circumferential guiding rib 510 on the bottom surface 506 of the top plate 500 and the upper circumferential guiding rib 470 on the top surface 405 of the middle plate 400 so as to cause the outwardly sloped outer wall 511 of the circumferential guiding rib 510 on the top plate 500 to contact the inner wall 462 of the upper circumferential guiding rib 470 on the middle plate 400 when the top plate 500 is placed upon the middle plate 400.

If desired, the upper panel 800 may be constructed so that the top plate 500 slopes from the front 1001 of the podium 1000 to the rear 1002 of the podium 1000 by configuring that portion of the upper panel 800 in connection with that segment of the circumferential channel 510 passing along the right 503 and left 504 sides of the top plate 500 are identically gradually inclined from front 1001 to rear 1002 of the podium 1000 while that portion of the upper panel 800 in connection with that segment of the circumferential channel 510 passing along the front edge 501 and back edge 502 of the top plate 500 are flat.

The specification presented above is intended to aid in a complete, nonlimiting understanding of the invention. Since many different embodiments may be produced without departing from the spirit and scope of the invention, the scope of the invention resides in the claims hereinafter appended.

I claim:

1. A kit for constructing a collapsible podium, comprising:

(a) a first laterally pliable, longitudinally rigid panel having a top edge, a bottom edge, a right edge and a left edge;

(b) a first plate having a top surface, a bottom surface, a substantially circumferential channel in the top surface into which the bottom edge of the first panel is operably receivable and an interior wall operable for conforming the first panel to the shape of the circumferential channel in the first plate prior to insertion of the bottom edge of the first panel into the circumferential channel in the first plate; and (c) a second plate having a top surface, a bottom surface, and a substantially circumferential channel in the bottom surface into which the top edge of the first panel is operably receivable.

2. The kit of claim 1 further comprising, (d) a second laterally pliable, longitudinally rigid panel having a top edge, a bottom edge, a right edge and a left edge, (e) a substantially circumferential channel in the top surface of the second plate into which the bottom edge of the second panel is operably receivable, and (f) a third plate having a top surface, a bottom surface, and a substantially circumferential channel in the bottom surface into which the top edge of the second panel is operably receivable.

3. The kit of claim 1 wherein the first panel comprises laterally spaced, longitudinally extending, structural support bars laminated to a completely pliable backing layer.

4. The kit of claim 2 wherein both the first and second panels comprise laterally spaced, longitudinally extending, structural support bars laminated to a completely pliable backing layer.

5. The kit of claim 3 wherein (i) the support bars comprise ridges in a layer of a rigid material which has a first surface, a second surface, and a plurality of laterally alternating, longitudinally extending ridges and grooves in the first surface, (ii) the backing layer is laminated to the second surface of the rigid material layer, (iii) the first panel further includes a first completely pliable cover layer laminated to the first surface of the support layer at the ridge apexes, and (iv) the first panel further includes a second completely pliable cover layer laminated to the backing layer.

6. The kit of claim 4 wherein (i) the support bars comprise ridges in a layer of a rigid material which has a first surface, a second surface, and a plurality of laterally alternating, longitudinally extending ridges and grooves in the first surface, (ii) the backing layer is laminated to the second surface of the rigid material layer, (iii) the first and second panels further includes first completely pliable cover layers laminated to the first surface of the support layer at the ridge apexes, and (iv) the first and second panels further include second completely pliable cover layers laminated to the backing layer.

7. The kit of claim 5 wherein the second completely pliable cover layer laminated to the backing layer does not substantially wrinkle when the panel is operably retained within a plate.

8. The kit of claim 6 wherein the second completely pliable cover layer laminated to the backing layer on both the first and second panels does not substantially wrinkle when the panel is operably retained within a plate.

9. The kit of claim 1 wherein the first panel has (i) a right side, (ii) a right edge, (iii) a left side, (iv) a left edge, (v) a first longitudinally extending, completely rigid bar operably secured proximate the right edge of the first panel so as to provide additional longitudinal support to the right edge of the first panel, and (vi) a second longitudinally extending, completely rigid bar operably secured proximate the left edge of the first panel so as to provide additional longitudinal support to the left edge of the first panel.

10. The kit of claim 2 wherein both the first and second panels have (i) a right side, (ii) a right edge, (iii) a left side, (iv) a left edge, (v) a first longitudinally extending, completely rigid bar operably secured proximate the right edge of the panel so as to provide additional longitudinal support to the right edge of panel, and (vi) a second longitudinally extending, completely rigid bar operably secured proximate the left edge of the panel so as to provide additional longitudinal support to the left edge of the panel.

11. The kit of claim 9 wherein the first and second bars comprise first and second channels which cover the right and left edges of the first panel respectively.

12. The kit of claim 10 wherein the first and second bars comprise first and second channels which cover the right and left edges of the first and second panels respectively.

13. The kit of claim 1 wherein (i) the first panel is about 2 feet to about 4 feet long top to bottom, (ii) the first and second plates have identically shaped circumferential channels, and (iii) the second plate has an upwardly facing surface area of about 100 $in^2$ to about 500 $in^2$.

14. The kit of claim 2 wherein (i) the first panel is about 2 feet to about 4 feet long from top to bottom, (i) the second panel is about foot to about 2 feet long from top to bottom, (iii) the first, second and third plates have identically shaped circumferential channels, and (iv) the third plate has an upwardly facing surface area of about 100 $in^2$ to about 500 $in^2$.

15. The kit of claim 1 wherein the length of the channels in the first and second plates and the lateral length of the first panel are cooperatively dimensioned such that a podium constructed from the kit will define a chamber having a top surface defined by the second plate, a bottom surface defined by the first plate, a front surface defined by the first panel, a right surface defined by the first panel, a left surface defined by the first panel, and an open rear surface.

16. The kit of claim 2 wherein the length of the channels in the second and third plates and the lateral length of the second panel are cooperatively dimensioned such that a podium constructed from the kit will define an upper chamber having a top surface defined by the second plate, a bottom surface defined by the third plate, a front surface defined by the second panel, a right surface defined by the second panel, a left surface defined by the second panel, and an open rear surface.

17. The kit of claim 1 further including (i) a means for positively retaining the bottom edge of the first panel within the channel in the top surface of the first plate and (ii) a means for positively retaining the top edge of the first panel within the channel in the bottom surface of the second plate.

18. The kit of claim 2 further including (i) a means for positively retaining the bottom edge of the first panel within the channel in the top surface of the first plate, (ii) a means for positively retaining the top edge of the first panel within the channel in the bottom surface of the second plate, (iii) a means for positively retaining the bottom edge of the second panel within the channel in the top surface of the second plate, and (ii) a means for positively retaining the top edge of the second panel within the channel in the bottom surface of the third plate.

19. The kit of claim 1 wherein the means for conforming the first panel comprises at least one guiding surface projecting upward from the top of the first plate immediately within the circumferential channel in the first plate.

20. A kit for constructing a podium which includes, a panel which is rigid in a first direction and supple in the transverse direction, and (ii) a substantially planar plate having a first curved channel into which a first edge of the panel is operably receivable and an interior wall operable for conforming the first panel to the shape of the circumferential channel in the first plate prior to insertion of the bottom edge of the first panel.

21. A kit for constructing a collapsible podium, comprising:

(a) a tambour-style panel having a top edge, a bottom edge, a right edge and a left edge;

(b) a first plate having a top surface, a bottom surface, a substantially rounded and continuous circumferential channel in the top surface into which the bottom edge of the tambour-style panel is operably receivable and an interior wall operable for conforming the tambour-style panel to the shape of the circumferential channel in the first plate prior to insertion of the bottom edge of the first plate into the circumferential channel in the first plate; and (c) a second plate having a top surface, a bottom surface, and a substantially rounded and continuous circumferential channel in the bottom surface into which the top edge of the first panel is operably receivable.

22. A kit for constructing a furniture element comprising:

(a) a ribbed panel, said panel comprising a top edge, bottom edge and first and second side edges;

(b) first means for supporting said panel, said first support means comprising a plate, said plate comprising a first peripheral channel for insertion of said ribbed panel top edge; and (c) second means for supporting said panel, said second supporting means comprising a plate, said plate comprising a second peripheral channel for insertion of said ribbed panel bottom edge, said second channel comprising an interior wall and an exterior wall, said second channel interior wall having a greater height than said second channel exterior wall.

23. A podium comprising the furniture element constructed from the kit of claim 22.

* * * * *